United States Patent [19]

Rogell

[11] 4,030,317

[45] June 21, 1977

[54] SIMULATED GEMSTONE

[76] Inventor: Paul S. Rogell, 95 Morgan St., Apt. 7B, Stamford, Conn. 06905

[22] Filed: July 16, 1973

[21] Appl. No.: 379,722

[52] U.S. Cl. ..... 63/32; 106/42; 428/15; 428/294

[51] Int. Cl.[2] ..... A44C 17/00

[58] Field of Search ..... 161/1, 5, 19; 63/32; 106/42; 428/15, 294

[56] References Cited

UNITED STATES PATENTS

| | | | |
|---|---|---|---|
| 3,148,967 | 9/1964 | Hicks | 65/4 |
| 3,539,379 | 11/1970 | Mayer | 63/32 |
| 3,581,522 | 6/1971 | Wincklhofer et al. | 161/5 X |
| 3,742,731 | 7/1973 | Phillips et al. | 63/32 |

*Primary Examiner*—F. Barry Shay

*Attorney, Agent, or Firm*—Flehr, Hohbach, Test

[57] ABSTRACT

An artificial ornamental stone of cabochon shape comprising a transparent light or yellowish brown matrix in which are embedded parallel to the base of the stone transversely orientated parallel fibers with greenish yellow transparent cores having a selected index of refraction clad in transparent sheaths which may be defined by the matrix and have an index of refraction less than the cores. In producing the base material for the stone, the fibers may be clad in one or more sheaths and embedded in the lower melting point matrix or the fibers may be unclad or partially clad and mixed with lower melting point and lower refractive index fibers and the assembly fused into an integral mass. The stone may be covered with a thin colorless, transparent, hard protective coating.

12 Claims, 10 Drawing Figures

SIMULATED GEMSTONE

BACKGROUND OF THE INVENTION

The present invention relates generally to improvements in artificial ornamental stones and decorative objects and it relates more particularly to improved artificial stones exhibiting chatoyancy and being highly wear resistant.

A highly attractive gem stone is cats-eye, a chrysoberyl which possesses chatoyancy and other desirable characteristics when properly cut as a cabochon. There are many stones which exhibit chatoyancy to various degrees. However, the gem chrysoberyl cats-eye is characterized by two optical effects, which are not present together in other cats-eye gemstones other than the alexandrite variety of chrysoberyl. The first is the formation of bright, narrow line as a result of corresponding point sources of light at or near the plane perpendicular to the base of the stone. The second is the formation over part of the stone body of a bright area of a color such as light greenish yellow or light yellowish brown, with the rest of the body a darker color, such as dark yellowish brown or brown or greenish yellow. This is often referred to as the "milk-and-honey" effect. It is caused by the stone being illuminated by a broad source of light or by a point source of light from the side, at an angle close to parallel to the base of the stone. The dividing line between the light and dark portions shows as a brighter line, whose width and intensity is a function of the size of the source of illumination. The rarest of gem cats-eyes, the alexandrite cats-eye, is chrysoberyl with impurities including a chromium impurity which alter the color absorption spectrum of the body of the stone such that a red or red-purple color is seen by incandescent illumination and a green color is seen by natural daylight illumination.

With two point sources of illumination as the stone is rotated in a plane parallel to its base, the separation of the two bright lines will change from a maximum to zero and back to maximum, thus giving the appearance of closing and opening of an eye.

Many attempts have been made to produce artificial cats-eyes and similar and related gem stones but the results have been far from satisfactory. The artificial stones previously produced lack the attractive and rich appearances of the natural stones and the artificial nature thereof is clearly apparent. Moreover, the methods heretofore employed are of very limited application and are lacking in versatility and adaptability.

Another drawback of most artificial gem stones, as well as many natural gem stones, is their low scratch and abrasion resistance by reason of the softness of the stone. Many artificial stones are formed of glasses or other man-made materials having hardness between 4 and 6 on the Mohs scale and are thus easily scratched or abraded in ordinary wear and by many of the domestic abrasive cleaners.

SUMMARY OF THE INVENTION AND OBJECTS

It is a principal object of the present invention to provide an improved artificial stone and a method of producing the same.

Another object of the present invention is to provide an improved artificial gem stone exhibiting chatoyancy and a method of producing the same.

Still another object of the present invention is to provide improved artificial gem stones simulating natural gem stones such as cats-eye, alexandrite, moonstone and the like as well as artificial gem stones of unique appearance.

A further object of the present invention is to provide an artificial gem stone of a relatively soft base material which is highly scratch and abrasion resistant.

Still a further object of the present invention is to provide an improved article of the above nature characterized by its attractive appearance, and close simulation of natural gem stones and to a method for producing the same which is simple, versatile and highly adaptable.

The above and other objects of the present invention will become apparent from a reading of the following description taken in conjunction with the accompanying drawing which illustrates preferred embodiments thereof.

In a sense the present invention contemplates the provision of an improved artificial gem stone comprising a plurality of parallel clad fibers including light transmitting cores and light transmitting sheaths of lesser refractive index than the cores, the fibers being surrounded by a light transmitting matrix and oriented to expose their ends to the front face of the gem stone. Advantageously the matrix is colored, or the clad fibers are enclosed in second, outer, light transmitting colored sheaths or colored rods are interspersed with the clad fibers. The fiber cores are advantageously likewise colored.

A highly faithful reproduction of the natural cats-eye is produced by employing a light or yellowish brown transparent matrix, transparent fiber cores of a greenish yellow color and clear transparent sheaths. The fiber cores are of a diameter between 2 microns and 25 microns, and a refractive index of 1.6 or more and the sheaths have an index of refraction more than 0.02 less than that of the core. The stone is cabochon shaped with the fibers extending parallel to the major axis and continuously between the opposite sides of the stone front face and the sheaths and matrix may constitute a common uniform body. The fibers, sheaths and matrix may be formed of glass, which is relatively soft and hence of low abrasion resistance. This drawback is overcome by coating the stone with a thin clear transparent colorless inorganic coating, such as a 2 micron thick aluminum oxide coating which is applied by ion sputtering techniques. A clear matrix may be employed and light brown secondary rods interspersed among the clad fibers or the clad fibers may be coated with second outer light brown sheaths. An alexandrite cats-eye may be produced by employing outer sheaths, matrix or secondary fibers of a color highly absorbent in the yellow-green range with absorption in the red as well. Where the fibers, sheaths and matrix are colorless, simulated moonstone is achieved. The cabochon may be of various shapes with the base face preferably flat and of any desired shape such as round, oval, square, rectangular, diamond, pear or kidney shape.

DESCRIPTION OF THE PREFERRED EMBODIMENT

Figure 1:
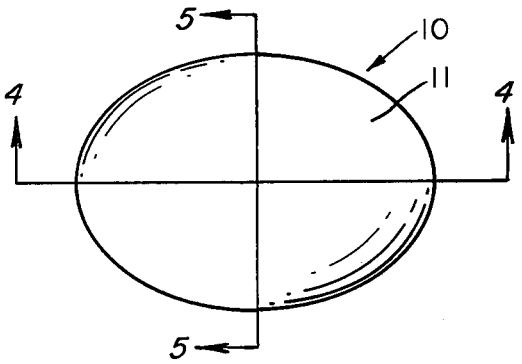
FIG. 1 is an enlarged top plan view of an artificial gem stone embodying the present invention.
Figure 2:
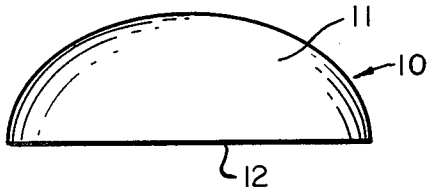
FIG. 2 is a side elevational view thereof.
Figure 3:
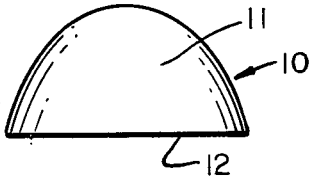
FIG. 3 is an end elevation view thereof.
Figure 4:
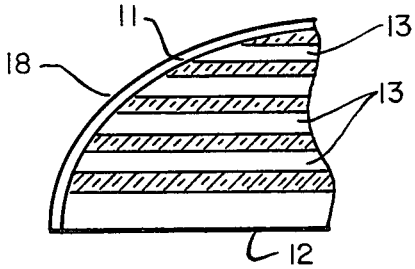
FIG. 4 is an enlarged fragmentary sectional view taken along line 4—4 in FIG. 1.
Figure 5:
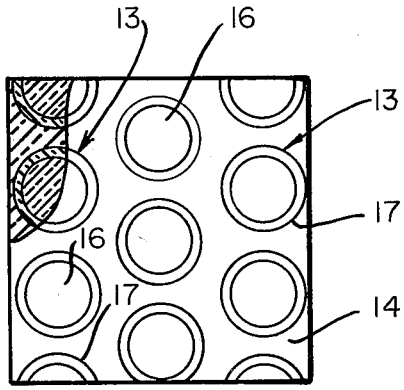
FIG. 5 is an enlarged fragmentary sectional view taken along line 5—5 in FIG. 1.

Referring now to the drawings, and particularly FIGS. 1 to 5 thereof which illustrate a preferred embodiment of the present invention, the reference numeral 10 generally designates an artificial stone embodying the present invention and simulating a cats-eye gem stone. The stone 10 is of the cabochon shape generally assumed by the gem cats-eye and includes a convex front face 11 and a flat base or rear face 12, it being noted that the base 12 may be of any desired configuration, for example, round, tear drop, diamond and the like.

The body of the stone 10 includes very closely spaced or juxtapositioned parallel clad fibers 13 embedded in a matrix 14, the fibers 13 and matrix 14 being bonded or fused into a unitary mass. The fibers 13 are oriented in a direction parallel to the base 12 and the major axis of the stone 10 and extend continuously from one side of front face 11 to the opposite side thereof whereby both ends of the fibers are exposed at the front face of the stone. The volume ratio of clad fibers 13 to matrix 14 is approximately 9:1.

Each of the fibers 13 includes an axial transparent glass core 16 of an index of refraction exceeding 1.6 and a transparent glass sheath 17 of an index of refraction less than that of core 16. In the present example, the core 16 is of roughly circular transverse cross section although other shapes may be employed, and it has a diameter of 10 microns and an index of refraction of 1.7 and the sheath 17 is about 0.5 microns thick and has an index of refraction of 1.49. The core 16 may be of a light greenish yellow color and the sheath 17 colorless and clear. The core 16 may be of other hues of green, yellow and brown in simulation of the natural cats-eye. The core may be colorless, which would produce a pleasing effect and possibly a useful simulated gemstone, although it would not be a true simulation of cats-eye. The matrix 14 may be, in the example described, light brown in color and transparent, with an index of refraction less than 1.7 and the thickness thereof surrounding and adjacent the individual fibers 13 between 0.02 and 5.0 microns. It should be noted that for mechanical reasons the temperature coefficient of expansions of the cores 16, sheath 17 and matrix 14 should be substantially equal or very close to one another to obviate any undue stresses or mechanical failures or adverse optical effects consequent to temperature changes during fabrication.

Since the components of the body of the stone 10 are formed of glass which has a hardness of less than 6, it would be highly susceptible to abrasion and scratching under normal wear. Accordingly, the stone 10 is provided with a colorless highly transparent coating 18 of alumina of a thickness of about 2.0 microns. The dimensions of stone 10 may be as desired but in simulation of the gem cats-eye it advantageously has an oval base of between 3 by 5 mm to about 18 by 25 mm.

In fabricating the improved stone 10 a block of base material in which the clad fibers 13 or groups of clad fibers called multifibers are embedded in matrix 14 is produced in any suitable manner, advantageously by inserting the closely packed parallel clad fibers 13 produced by conventional procedures into an envelope formed of the material of matrix 14, maintaining the interior of the envelope under vacuum and heating the evacuated packed envelope to the fusion or melting point thereof. A description of the bonding and fusion process is described in U.S. Pat. No. 3,148,967 granted Sept. 15, 1964 to J. W. Hicks, Jr.

The base material as produced above is then cut and ground to the desired cabochon shape and polished, the fibers 13 being oriented in a direction parallel to the base and the major axis of the stone 10 to extend from one side of the face to the other.

Thereafter, the coating 18 is applied to the stone 10 by the technique of ion sputtering or RF induced plasma sputtering which is generally well known. The stone or substrate 10 and a source target of the coating material, for example, aluminum oxide are positioned in a chamber which is evacuated and an inert gas such as argon is then introduced and ionized by the application of a suitable voltage. Alternate methods of deposition of the coating are e-gun electron beam evaporation and vacuum electroplating. The ion stream is first directed at the stone 10 to clean it and then at the source target to sputter high energy aluminum oxide molecules therefrom which deposits on the stone 10 with sufficient kinetic energy to provide a hard clear transparent coating highly adherent to the substrate stone.

The coating 18 is advantageously clear, transparent and colorless and formed of an inert inorganic material having a hardness of at least 7.0. It should be of thickness of greater than 0.01 micron. The optimum thickness would vary for different materials. Examples of materials which may be employed are aluminum oxide, silicon carbide, molybdenum disulphide and other suitable synthetic materials such as many metallic carbides and nitrides, silica or a hard metal such as chromium, and the like. In order to achieve further toughness and adherence, an intermediate layer of different material greater than 0.01 micron thick, may be deposited between the body material and the hard outer layer.

The improved stone 10 produced in the above manner is a highly faithful simulation of a corresponding natural cats-eye and possesses the appearance and optical properties which characterize the natural cats-eye. The bright line is created when light from a single source reflects off the side walls of the surface fibers which act as cylindrical reflectors. If there are more than one source, there will be correspondingly more than one line. The milk-and-honey effect is caused by light transmitted by the fibers which act as light pipes with total internal reflection. It is also possible to have a combination of the two effects depending upon the position of the light source which causes a bright area that is in between the bright line and the milky portion of the milk-and-honey effect. Moreover, the stone 10 is highly wear resistant by reason of the coating 18.

While specific diameters and dimensions have been given in the specific embodiment described above, there may be varied and excellent results and different effects and appearances achieved. While the diameters of the fiber cores 16 may be up to 50 microns, they are advantageously of diameters between 2 and 25 microns, since where the diameters exceed 25 microns the fiber or multifiber boundaries may be visually apparent, and also the bright line resulting from a point source is broader, and a poorer simulation results. Moreover, the refractive index of cores 16 should preferably be at least 1.6 to achieve a fiber numerical aperture approaching 1.0 or greater, a highly desirable property, indices of refraction of 1.6 or less resulting in poorer simulation. The fiber sheaths 17 should be thick enough to effect maximum internal reflections along the fiber cores 16 and are typically one twentieth of the core diameter for a 10 micron diameter core although this ratio may be reduced for larger core diameters and advantageously increased for small core diameters. The sheath index of refraction should be as low as possible relative to that of the core 16 and is typically less than 1.55. The sheath 17 is advantageously colorless since where it is colored, its color will diffuse into the core, even with little or no diffusion, and due to the many reflections at the sidewalls will affect the color of the light transmitted along the cores and adversely affect the simulation of a chrysoberyl cats-eye.

By varying the colors of the different components of the stone 10 other natural stones may be simulated or stones of unique appearance may be produced. Thus, by making the matrix instead of the light or yellow-brown, a color which has a high absorption in the yellow-green band and some in the red band so that it will transmit sunlight primarily as blue-green and incandescent light as red, an alexandrite cats-eye is simulated. A faceted stone made entirely of this matrix material, with no fibers, would simulate an alexandrite, which is one of the rarest and most valuable of the colored precious stones. It should be noted that where the cores, sheaths and matrix are colorless, a moonstone is simulated.

Figure 6:
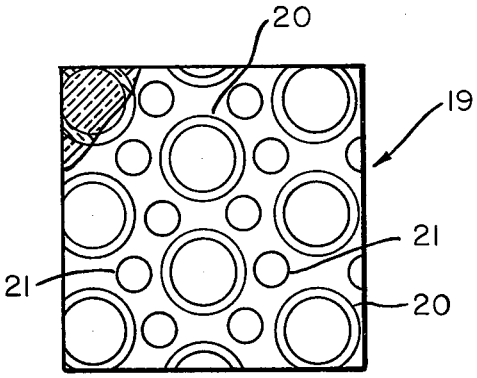
FIG. 6 is a view similar to FIG. 4 of another embodiment of the present invention.

In FIG. 6 of the drawing there is illustrated another embodiment of the present invention which differs from that first described primarily in that the secondary color is achieved by means of colored rods 21 instead of the colored matrix. Specifically, the improved stone comprises a body 19 including clad fibers 20 which correspond in structure, properties, orientation and relationship to the clad fibers 13 earlier described.

Colored fibers or rods 21 parallel to fibers 20 are distributed through and intermixed with the fiber 20. Rods 21 are light transmitting, advantageously transparent, have a color corresponding to but preferably darker than that of matrix 14, and diameters between 0.1 and 1.0 of that of fibers 20. The fibers 20 and rods 21 may be fused or bonded as such into an integral mass, or may be so bonded and fused with a colorless transparent matrix in the manner earlier described. The volume occupied by rods 21 is sufficient to impart the desired color to the stone and is advantageously less than 5% and preferably less than 1 percent by volume of the finished stone.

Figure 7:
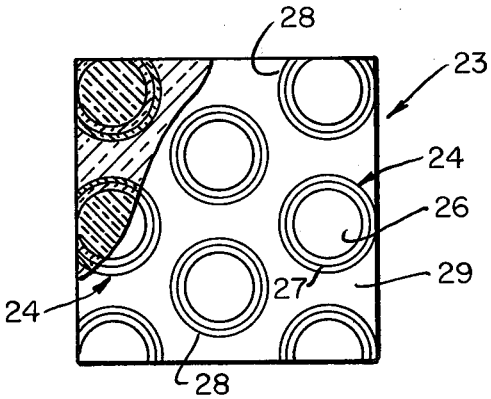
FIG. 7 is a view similar to FIG. 4 of still another embodiment of the present invention.

Another embodiment of the present invention is illustrated in FIG. 7 and differs from the first described embodiment in that the secondary color is achieved by providing the clad fibers with light transmitting outer or second sheaths of a color corresponding to that of matrix 14. The mass 23 which forms the stone is formed of parallel fibers 24 oriented in the manner of fibers 13. Each fiber 24 includes a light transmitting, colored, advantageously transparent core 26, a thin, advantageously colorless, transparent first sheath 27 coating the core 26 and of an index of refraction less than that of core 26, and a colored second transparent sheath 28 covering the first sheath 27. The indices of refraction of cores 26 and sheaths 27 correspond to those of cores 16 and sheaths 17. the refractive index of sheath 28 is preferably lower than that of sheath 27 and its thickness of the order of 0.01 of the core diameter. The doubly clad fibers 24 are advantageously fused or bonded to each other or may be embedded in and fused with a transparent colorless matrix 29. In all other respects the artificial stones shown in FIGS. 6 and 7 are similar to that of the first embodiment and the various described modifications thereof.

Figure 8:
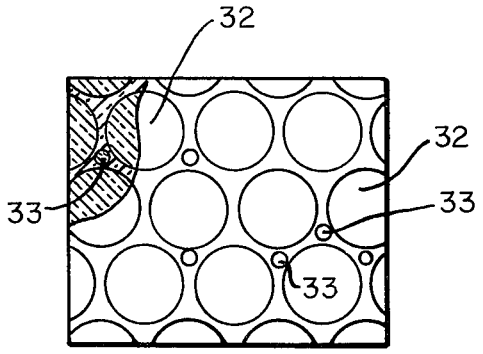
FIG. 8 is an enlarged transverse sectional view of an assembly of components for the production of a base material in accordance with the present invention.
Figure 9:
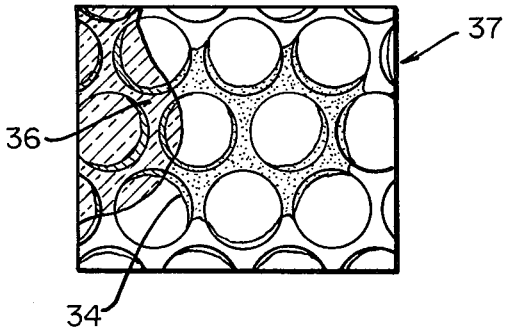
FIG. 9 is a view similar to FIG. 8 of the finished base material.
Figure 10:
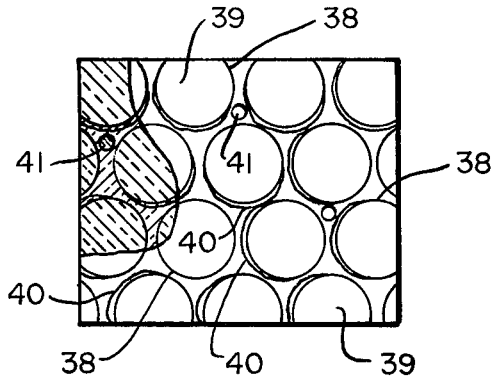
FIG. 10 is a view similar to FIG. 8 of a modified assembly.

Other improved methods which may be employed to great advantage in producing ornamental stones in accordance with the present invention rely on the use and production of base materials from the component assemblies illustrated in FIGS. 8–10 of the drawings. Specifically, referring to FIG. 8, an assembly or mass of relatively large unclad light transmitting, preferably transparent fibers 32 have distributed therethrough parallel advantageously light transmitting, preferably transparent, rods 33. The fibers 32 are advantageously in juxtaposition, with the rods 33 occupying some or all of the spaces delineated by the fibers 32, being randomly or regularly distributed. The fibers 32 and rods 33 are preferably glass and of different colors with the material forming the matrix for the first fibers and the rods 33 having a lower melting point and a lower index of refraction than the material forming the first fibers 32. The first fibers 32 are advantageously of diameters between 2 microns and 50 microns and may be clear or colored and the various characteristics of the fibers 32 and rods 33, in addition to those described above may correspond to those of fiber cores 16 and matrix 14 as earlier set forth.

After any method of fiber construction and arrangement described herinabove has been performed, the next step in processing could use alternate methods to form the block of material which is cut into individual pieces which are ground and polished to form the simulated gem.

By way of example, alternate methods could be:

1. Groups of the individual fibers are fused while being drawn into a multifiber rod, as described in the above identified Hicks patent. The preferred multifiber rod shape has hexagonal cross-section with diameter typically 0.025 inch to 0.100 inch. Other cross-sections could be used. The multifiber rods, together with colored rods if applicable, are then stacked in a mold and fused into a block;

2. Multifiber rods are formed as in (1) and then groups of multifiber rods are fused while being drawn into a multi-multifiber rod. Then the multi-multifiber rods are stacked, with colored rods if applicable, in a mold and fused into a block; and 3. Individual fibers, and colored rods if applicable, are stacked in a mold and fused into a block. This method is practical only if fibers are typically 25 microns diameter or larger.

The assembled fibers 32 and rods 33, or the multifibers, or the multi-multifibers and rods are placed in a mold and heated to the fusion temperature of the sheath of the first fibers. The lower melting point secondary rods 33 freely flow to fill most or all of the void spaces initially delineated by the first fibers 32 and may diffuse or bleed into the outer surfaces of the first fibers 32. With the rise in temperature to the fusion point of the first fibers 32 the whole assembly is fused into an integral mass of base material including the longitudinally extending first fibers 32, having surface layers of the material of the rods 33 and being substantially embedded therein. Thus, as shown in FIG. 9, the melt distributed material of the rods 33 functions as sheaths 34 for the first fibers 32 as well as a filler matrix 36. The base material 37 thus produced is cooled and shaped in the manner earlier described, advantageously into cabochon configuration with fibers 32 parallel to the base and maps axis thereof. The polished stone may then be coated such as by sputtering with a transparent layer of a hard material.

The method last described may be modified by employing the assembly illustrated in FIG. 10 of the drawing. Specifically the assembly employs preclad fibers 38 which includes cores 39 corresponding in dimensions and parameters to fibers 32 the cores being partially clad by light transmitting sheaths 40 which extend only partially about cores 39 preferably between one half and three fourths of the periphery of the respective cores, and are formed of a material of lower refractive index than that of cores 39. Rods 41 of lower melting point and different color than cores 39 and corresponding to rods 33 are distributed among the fibers 38 and the assembly fused in the manner described above. The resulting base material, which is of the nature of base material 37, is then cut, polished and coated as in the last embodiment to produce ornamental stones in accordance with the present invention.

While a cabochon produced from the base material 37 does not exhibit the true milk-and-honey effect of the natural chrysoberyl cats-eye, where the milk portion of the stone is normally a light yellow-green, it will show a light and dark effect where the dark portion will be the body color. Such a cats-eye produces an eye effect as good as the natural chrysoberyl cats-eye, since the bright lines of the eye is a function of the diameter and parallelism of the fibers.

While there have been described and illustrated preferred embodiments of the present invention, it is apparent that numerous alterations, omissions and additions may be made without departing from the spirit thereof. For example, while the improved product has been described as an artificial gem stone of rigid structure, but may be non-rigid and of various configurations and applications. It may be employed for personal decorative accessories such as for belts, shoes, bracelets, clothing, necklaces and the like as well as for lamps, sculpture and other applications.

I claim:

1. An ornamental artificial gem stone having a front face, comprising a body member of parallel light transmitting fibers, said fibers including respective cores of a first material having a first index of refraction, said cores extending across the gem stone to present their ends at the front face of the gem stone, said fibers further including respective coatings on the surfaces of said cores having a second index of refraction, said first index of refraction being greater than said second index of refraction, a light transmitting matrix surrounding said fibers throughout said body member, including a plurality of colored unclad light transmitting rods disposed throughout said matrix and distributed among said fibers, said colored unclad rods being of sufficient concentration in said matrix to impart their color to the gem stone.

2. The artificial gem stone of claim 1 wherein the index of refraction of said first material exceeds 1.6.

3. The artificial gem stone of claim 1 wherein the index of refraction of said first material is at least 1.6 and the index of refraction of said second material is at least 0.2 less than that of said first material.

4. The artificial gem stone of claim 1 wherein said light transmitting cores have diameters not exceeding 50 microns.

5. The artificial gem stone of claim 1 wherein said light transmitting cores have diameters between 2 microns and 50 microns, and said first material has an index of refraction not less than 1.6.

6. The artificial gem stone of claim 5 wherein said gem stone haas a convex front face, and said light transmitting cores extend between opposite sides of the front face.

7. The artificial gem stone of claim 1 wherein the front face includes a transparent coating overlying and adherent thereto and having a hardness of at least 7.0 on the Mohs Scale.

8. An artificial ornamental stone having a convex front face, comprising an integrated body member of parallel partially clad fibers continuously extending between opposite sides of said front face to present their ends to said front face and having colored light transmitting cores of a first material, said light transmitting cores being partially clad about the surface thereof by light transmitting partial sheaths having a color different from and an index of refraction less than said light transmitting cores, a light transmitting matrix surrounding said fibers throughout said body member, said matrix having an index of refraction less than that of said cores, whereby a secondary color corresponding to the color of said partial sheaths is obtained in light transmitted through said integrated body member.

9. The artificial ornamental stone of claim 8 wherein said matrix is diffused into the surface areas of said cores.

10. An artificial ornamental stone comprising a body member of relatively soft glass multifibers embedded in a relatively soft fusion matrix, said glass multifibers including light transmitting cores having one index of refraction and transparent sheaths on said light transmitting cores having an index of refraction less than said one index of refraction, said glass multifibers being in parallel juxtaposition, and homogenous light transmitting rods distributed in parallel relationship thereamong, said light transmitting cores and rods being of different colors, said body member thereby displaying a primary and a secondary color corresponding to the different colors of said glass multifibers and said homogenous rods, said body member having a front face and at least one transparent layer overlying and adherent to said front face, said layer being of a thin inorganic material harder than said body member and having a hardness of at least 7.0 on the Mohs scale.

11. The artificial ornamental stone of claim 10 wherein the thickness of said layer exceeds 1.5 microns and the layer is colorless.

12. An artificial ornamental stone having a convex front face, comprising an integrated body member of parallel clad fibers continuously extending between opposite sides of said front face to present their ends to said front face, said parallel clad fibers including light transmitting cores of a first material and a first color, an inner light transmitting sheath of a second material of lesser index of refraction than said first material and an outer light transmitting sheath of a third material having a second color and lesser index of refraction than said second material, and a matrix in which said parallel clad fibers are embedded whereby a secondary color is obtained in light transmitted through said integrated body member.

* * * * *